US006854451B2

(12) United States Patent
Ebihara et al.

(10) Patent No.: US 6,854,451 B2
(45) Date of Patent: Feb. 15, 2005

(54) FUEL FEED APPARATUS HAVING VIBRATION DAMPING STRUCTURE

(75) Inventors: Yoshio Ebihara, Kariya (JP); Kiyoshi Nagata, Nagoya (JP); Katsuhisa Yamada, Okazaki (JP); Kouji Izatani, Nagoya (JP); Tatsuo Sakai, Kariya (JP); Kunihiro Umetsu, Anjo (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/722,541

(22) Filed: Nov. 28, 2003

(65) Prior Publication Data

US 2004/0112819 A1 Jun. 17, 2004

(30) Foreign Application Priority Data

Nov. 28, 2002 (JP) ..... 2002-345660
Oct. 10, 2003 (JP) ..... 2003-351897

(51) Int. Cl.[7] ..... F02M 37/04
(52) U.S. Cl. ..... 123/509
(58) Field of Search ..... 123/509, 510, 123/516, 495; 137/590

(56) References Cited

U.S. PATENT DOCUMENTS 4,718,208 A * 1/1988 Fons ..... 52/192
4,776,315 A * 10/1988 Greiner ..... 123/509
4,869,225 A * 9/1989 Nagata et al. ..... 123/509
4,974,570 A * 12/1990 Szwargulski et al. ..... 123/509
5,038,741 A 8/1991 Tuckey
5,046,471 A * 9/1991 Schmid ..... 123/509
5,769,061 A 6/1998 Nagata et al.
6,253,738 B1 * 7/2001 Takahashi et al. ..... 123/509
6,293,256 B1 * 9/2001 Kleppner et al. ..... 123/509
6,675,778 B1 * 1/2004 Kemper et al. ..... 123/516

* cited by examiner

*Primary Examiner*—Mahmoud Gimie
(74) *Attorney, Agent, or Firm*—Nixon & Vanderhye PC

(57) ABSTRACT

A fuel feed apparatus accommodates a sub tank. The sub tank includes a pump module The pump module generates vibration, and is supported by a supporting member and a suction filter. The suction filter is covered with a nonwoven fabric. The nonwoven fabric is used as an additional filter for removing debris in fuel drawn by the pump module. The supporting member and the nonwoven fabric have resilience. The pump module is mounted on the sub tank via the supporting member and the non woven fabric. Therefore, vibration of the pump module is not apt to be transmitted to the sub tank. Additionally, the supporting member need not to be rigidly formed, so that the supporting member can be manufactured easily.

25 Claims, 10 Drawing Sheets

FUEL FEED APPARATUS HAVING VIBRATION DAMPING STRUCTURE

CROSS REFERENCE TO RELATED APPLICATION

This application is based on Japanese Patent Applications No. 2002-345660 filed on Nov. 28, 2002 and No. 2003-351897 filed on Oct. 10, 2003, the disclosure of which is incorporated herein by reference.

BACKGROUND OF THE INVENTION

The present invention relates to a fuel feed apparatus, that includes a fuel pump provided in a fuel tank.

Conventionally, an in-tank type fuel feed apparatus is used for drawing fuel in a fuel tank and discharging the fuel. Here, a fuel pump is disposed in the fuel feed apparatus, which is in the fuel tank. According to JP-A-9-268956 (U.S. Pat. No. 5,769,051), a pump module is accommodated in a sub tank. The pump module includes a fuel filter surrounding the periphery of the fuel pump and the fuel pump. According to U.S. Pat. No. 5,038,741, a pump is accommodated in a canister. The pump directly draws fuel in the fuel tank through the filter which protrudes from the bottom area of the canister to the outside of the canister.

In a fuel feed apparatus according to the JP-A-9-268956, the fuel filter of the pump module is directly connected with the sub tank. Therefore, vibration of the fuel pump is transmitted to outside components from the fuel tank through the fuel filter, the sub tank and the fuel tank. Especially, vibration of the fuel pump is transmitted to the passenger compartment.

In a fuel feed apparatus according to the JP-A-9-268956, the upper side of the fuel pump is fixed to the canister using a spring, so that vibration of the fuel pump is not apt to be transmitted to the canister from its upper side. However, the suction port of the fuel pump fits to the canister, and the bottom section of the canister contacts the inner wall of the bottom section of the fuel tank, so that the vibration of the fuel pump may be transmitted to the fuel tank through the suction port and the canister.

SUMMARY OF THE INVENTION

In view of the foregoing problems, it is an object of the present invention to propose a fuel feed apparatus where vibration is less transmitted to outside.

In the present invention, a casing is connected with the sub tank via a supporting member. The casing accommodates the pump. The casing contacts the sub tank via a suction filter. The supporting member has resiliency, so as to absorb vibration of the fuel pump. Therefore, vibration of the fuel pump is not apt to be transmitted to the sub tank via the supporting member. The suction port of the fuel pump does not directly contact sub tank, so that vibration of the fuel pump is less transmitted from the suction port to the sub tank.

Furthermore, the casing is supported by the sub tank via the supporting member and the suction filter. Namely, the casing is supported by not only the supporting member. Therefore, the supporting member need not be highly rigid. That is, the supporting member can be resilient. Thus, manufacturing of the supporting member becomes easy. Besides, the supporting member is connected with the sub tank at multiple points, so that eccentric vibration can be prevented. As described in following embodiment, the supporting member can directly connect with the fuel pump, so that the resilient supporting member can connect the fuel pump and the sub tank, or the resilient supporting member can connect the fuel pump and the fuel tank, for example.

BRIEF DESCRIPTION OF THE DRAWINGS

Other objects, features and advantages of the present invention will become more apparent from the following detailed description made with reference to the accompanying drawings, in which.

DETAILED DESCRIPTION OF THE PREFERRED EMBODIMENTS (First Embodiment)

Figure 1:
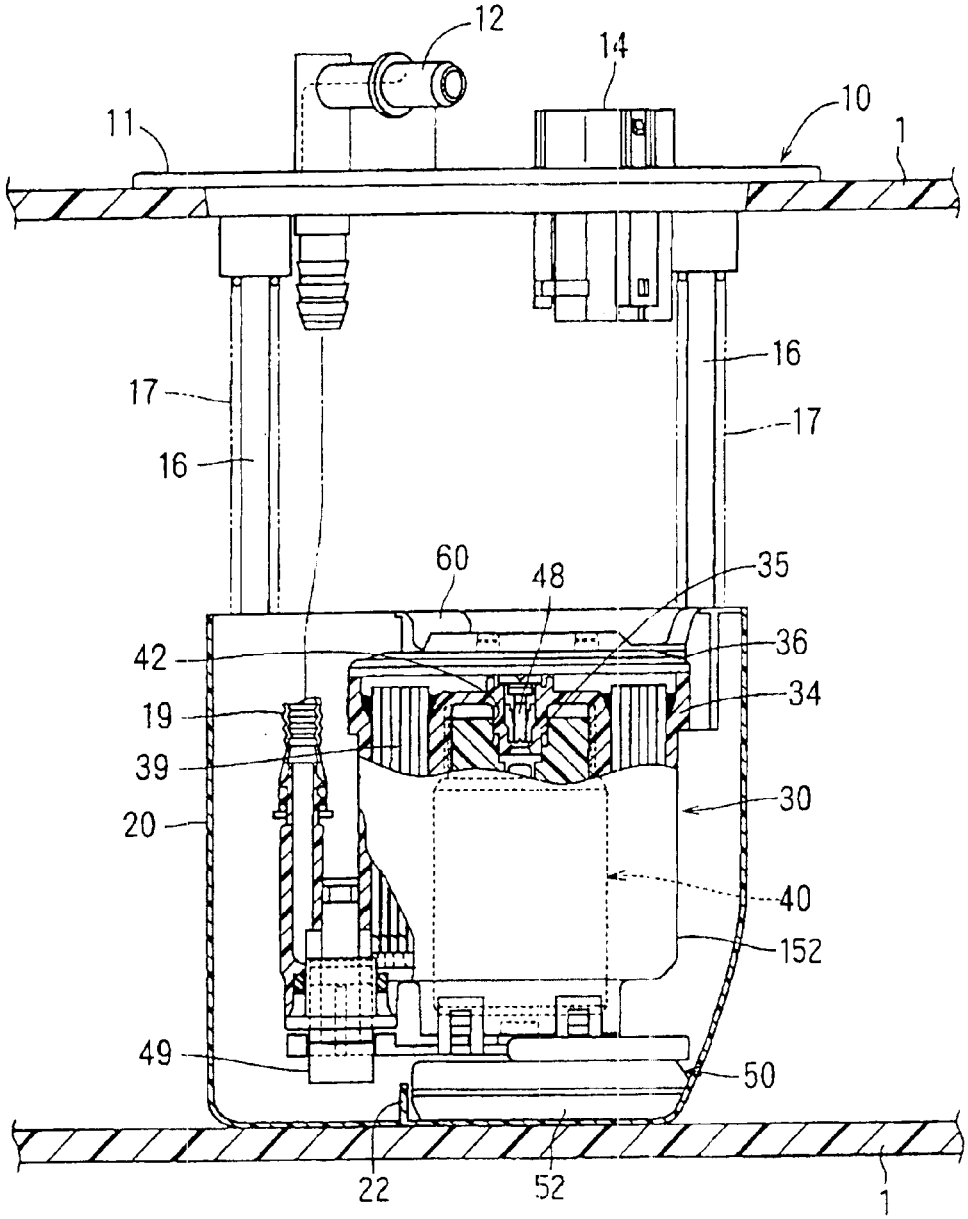
FIG. 1 is a partially cross-sectional side view showing the fuel feed apparatus according to the first embodiment of the present invention.

As shown in FIG. 1, a lid 11 of a fuel feed apparatus 10 is formed in a disc-shape and mounted on the top wall of a resinous fuel tank 1. The fuel tank 1 can be made of a metallic material. Other members of the fuel feed apparatus 10 are accommodated in the fuel tank 1. The fuel tank 1 has a tank section. A jet pump can transfer fuel from the tank section toward another tank section which includes a pump module 30 inside the fuel feed apparatus 10.

Figure 2A:
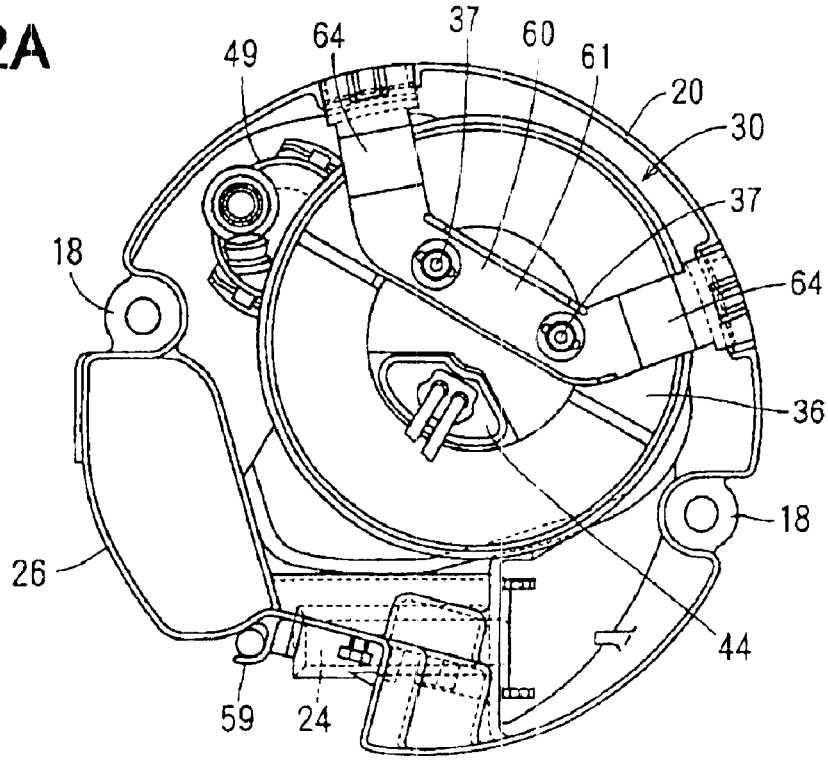
FIG. 2A is a top view showing the fuel feed apparatus according to the first embodiment.
Figure 2B:
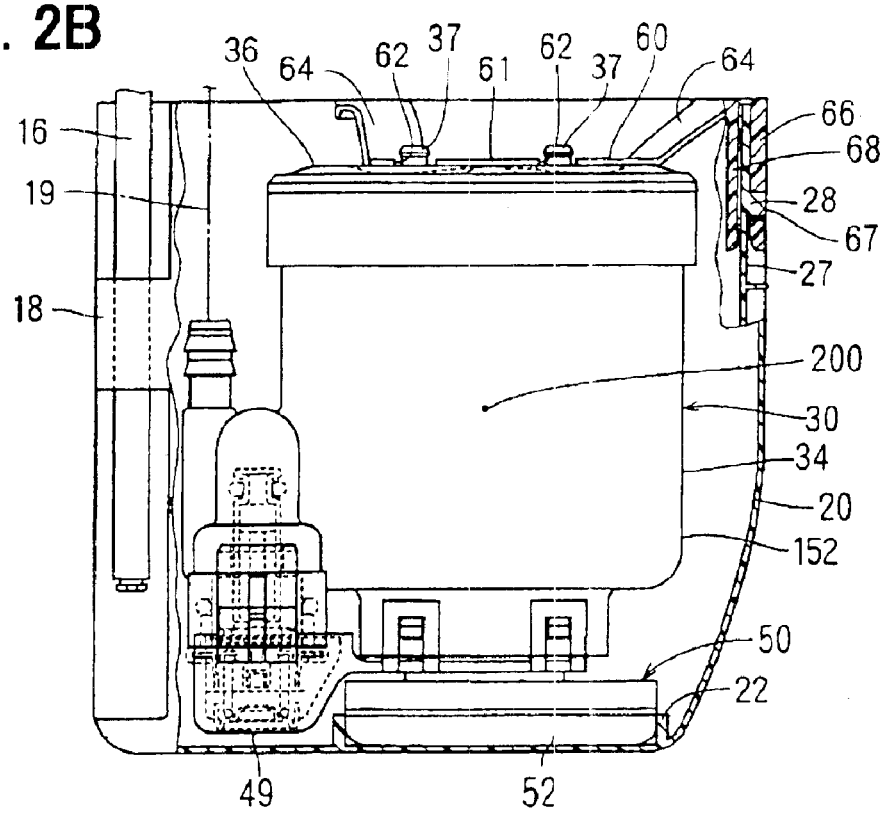
FIG. 2B is a partially cross-sectional side view showing the fuel feed apparatus according to the first embodiment.

A discharge pipe 12 and an electric connector 14 are built on the lid 11. Fuel is discharged from a fuel pump 40 of the pump module 30 toward outside of the fuel tank 1 through the discharge pipe 12. The connector 14 supplies the fuel pump 40 with electric power via lead wires. A metallic pipe 16 is press-inserted into the lid 11 at its one end, and loosely inserted into an insertion section 18 at the other end (FIGS. 2A and 2B). The insertion section 18 is formed in a sub tank 20. A spring 17 presses the lid 11 and the sub tank 20 so as to be separated each other. Accordingly, the bottom face of the sub tank 20 is pressed onto the inner bottom face of the fuel tank 1. Therefore, the bottom section of the sub tank 20 is subjected to force by the spring 17 so as to be constantly pressed onto the inner bottom face of the fuel tank 1, regardless of expansion or shrinkage of the resinous fuel tank 1 due to changing inner pressure caused by temperature variation and changing amount of fuel in the fuel tank 1.

The pump module 30 and the like are accommodated in the sub tank 20. The pump module 30 includes a casing 34, a lid 36, the fuel pump 40, a filter element 39, a suction filter 50 and a pressure regulator 49. The filter element 39 surrounds the outer periphery of the fuel pump 40. The casing 34 and the lid 36 are fixed using welding or the like. An inlet port 35 of the casing 34 fits to a discharge port 42 of the fuel pump 40 so as to be connected each other. A check valve 48 is accommodated in the inlet port 35 for preventing fuel from reverse flow toward the fuel pump 40. The filter element 39 removes debris contained in fuel discharged from the fuel pump 40.

The fuel pump 40 is vertically accommodated in the sub tank 20, so that its fuel discharge port is positioned on the upper side, and the fuel suction port is positioned on the lower side as shown in FIG. 1. An electric connector 44 (FIG. 2A) of the fuel pump 40 is exposed from the lid 36 so as to be wired with the connector 14. The fuel pump 40 accommodates a motor (not shown) for driving an impeller or the like, so as to generate suction pressure. The inlet port of the pressure regulator 49 is connected with a discharge port of the casing 34. Fuel is discharged from the fuel pump 40, and debris is removed by the filter element 39, subsequently, the pressure of the discharged fuel is controlled by the pressure regulator 49. The fuel flows toward the discharge pipe 12 through the flexible tube 19.

The suction filter 50 is connected with the suction port of the fuel pump 40, and contacts the inner wall in the bottom area of the sub tank 20. The outer periphery of the suction filter 50 is covered with a nonwoven fabric (filtering material) 52. The nonwoven fabric 52 is used as a filter for removing relatively large debris contained in the fuel, which is drawn by the fuel pump 40 from the sub tank 20. The bottom section of the nonwoven fabric 52 contacts the inner wall in the bottom area of the sub tank 20. A protrusion 22 is formed on the inner wall in the bottom area of the sub tank 20.

The suction filter 50 is surrounded by the protrusion 22 so as to be positioned. A jet pump 59 (FIG. 2A) is provided outside of the sub tank 20 for supplying fuel to inside of the sub tank 20. Surplus fuel is exhausted from the pressure regulator 49. Surplus fuel is also returned from the engine side. The jet pump jets the surplus fuel so as to feed fuel from the fuel tank 1 toward the sub tank 20 through a suction port 24. The sub tank 20 is filled with fuel, even if amount of the fuel in the fuel tank 1 is decreased. Another jet pump (not shown) is accommodated in a housing 26 of the sub tank 20 for transferring fuel in another tank toward a tank section in which the pump module 30 is included.

Figure 3:
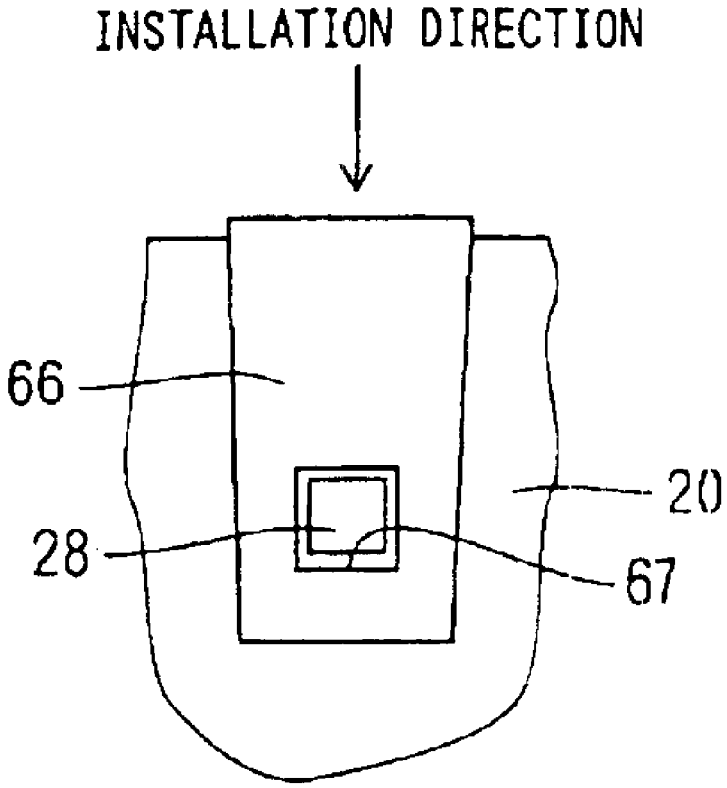
FIG. 3 is a partial side view showing a snap fitting section between a supporting member and a sub tank.

As shown in FIG. 2, a supporting member 60 connects the lid 36 of the casing 34 (more specifically, a top end surface of the lid 36) and the sub tank 20 on the upper side of the suction filter 50. The lid 36 is located on the upper side of a center of gravity 200 of the pump module 30, and positioned on the top surface of the pump module 30. The supporting member 60 is an integrally formed thin plate, and has resilience. The supporting member 60 includes a central section 61 and two arm sections 64. The central section 61 snap-fits to the lid 36. The two arm sections 64 snap-fit to a peripheral wall 27 of the sub tank 20. Protrusions 37 protrude on the top surface of the lid 36. The protrusions 37 snap-fit to fitting holes 62 of the central section 61, so that the central section 61 and the lid 36 are connected. Therefore, the supporting member 60 and the lid 36 are easily connected and removed each other. Each arm section 64 is used as a connecting member. The arm section 64 of the supporting member 60 has an outer peripheral section 66 and an inner peripheral section 68 for clipping the peripheral wall 27 in the diametrical direction of the sub tank 20. The gap between the outer peripheral section 66 and the inner peripheral section 68 is slightly wider than the thickness of the peripheral wall 27 of the sub tank 20. As shown in FIGS. 1 and 3, windows 67 are formed as hocking sections in the outer peripheral sections 66, so as to hook the claws 28 which protrude from the peripheral wall 27. The outer peripheral section 66 extends substantially in a direction where the sub tank 20 is joined with the pump module 30. Therefore, the windows 67 of the outer peripheral sections 66 fit to the claws 28, so that the outer peripheral sections 66 hook on the claws 28 in the direction where the sub tank 20 is joined with the pump module 30, namely the direction where the sub tank 20 is joined with the supporting member 60. Accordingly, two different manufacturing works can be performed simultaneously, the two different manufacturing works include a mounting work of the pump module 30 into the sub tank 20, and a manufacturing work in which the supporting member 60 is hooked on the sub tank 20.

Next, detail of vibration reduction of the fuel pump 40 will be described. The pump module 30 contacts the inner wall in the bottom area of the sub tank 20 via the suction filter 50, and connected with the sub tank 20 via the supporting member 60. The suction filter 50 receives weight of the pump module 30 and resilient force applied by the supporting member 60 to the pump module 30. The fuel pump 40 vibrates when the motor of the fuel pump 40 is operated for drawing and discharging fuel. The vibration of the fuel pump 40 is transmitted to the sub tank 20 via the supporting member 60 and the suction filter 50. Even if vibration is transmitted from the fuel pump 40 to the supporting member 60 via the lid 36, the vibration is absorbed by the resilient supporting member 60, so that the vibration is reduced. Additionally, the thick nonwoven fabric 52 covers the outer periphery of the suction filter 50, and contacts the inner bottom wall of the bottom area of the sub tank 20. Therefore, the vibration generated by the fuel pump 40 is absorbed by the suction filter 50 so as to be reduced. Thus, the vibration is less transmitted from the fuel pump 40 to the sub tank 20 and the fuel tank 1.

Furthermore, the center of gravity 200 of the pump module 30 is positioned lower than the snap-fitted section between the pump module 30 and the supporting member 60, and is positioned upper than the connecting section between the pump module 30 and the suction filter 50, so that vibration of the pump module 30 can be reduced. Swinging of the pump module 30 with respect to the sub tank 20, which is due to vibration of the fuel pump 40 and swinging of the vehicle, can be reduced. Furthermore, the protrusions 22 is formed on the inner wall in the bottom area of the sub tank 20 so as to surround the suction filter 50, so that displacement of the suction filter 50 can be prevented.

(Second Embodiment)

Figure 4A:
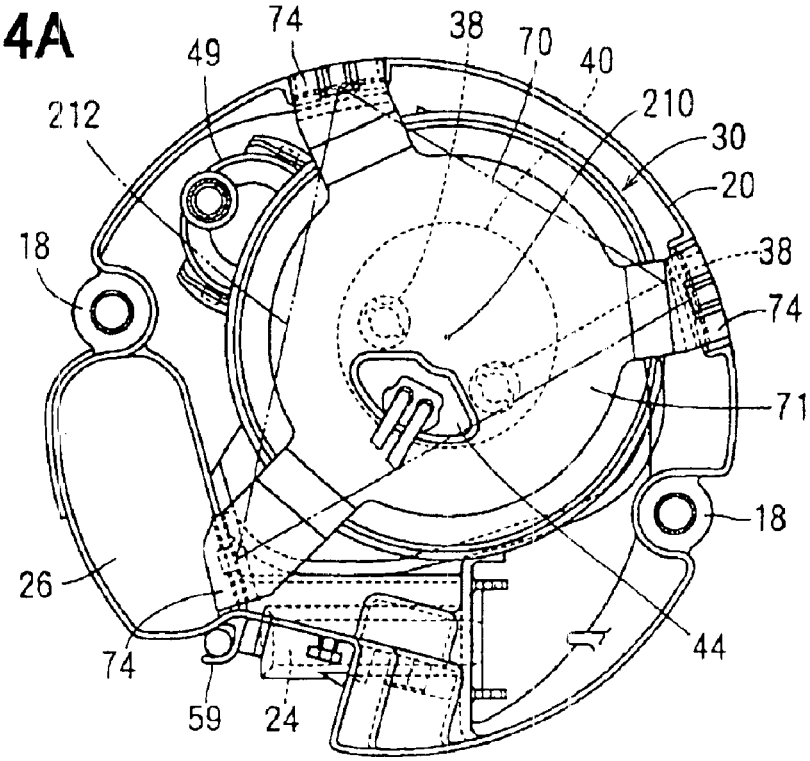
FIG. 4A is a top view showing the fuel feed apparatus according to a second embodiment of the present invention.
Figure 4B:
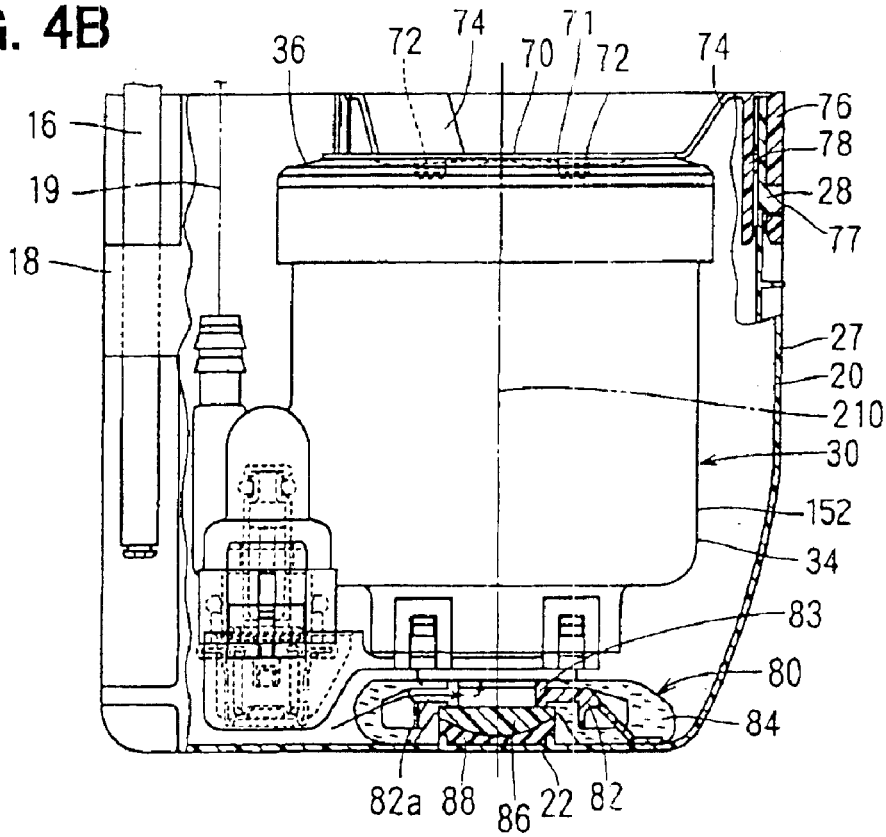
FIG. 4B is a partially cross-sectional side view showing the fuel feed apparatus according to the second embodiment.

As shown in FIG. 4, a supporting member 70 connects the lid 36 of the casing 34 and the sub tank 20. The supporting member 70 is made of a resilient thin plate. The supporting member 70 has a central section 71 and three arm sections 74. The central section 71 snap-fits to the lid 36, and the three arm sections 74 snap-fit to the peripheral wall 27 of the sub tank 20. Protrusions 72 are formed on the central section 71 toward the lid 36. Fitting holes 36 are formed on the top surface of the lid 36. The protrusions 72 snap-fit to the fitting holes 38 at two places, so that the central section 71 is connected with the lid 36. Each arm section 74 of the supporting member 70 has an outer peripheral section 76 and an inner peripheral section 78, for clipping the peripheral wall 27 in the diametrical direction of the sub tank 20. A window 77 is formed in each outer peripheral sec-ion 76 so as to hook each corrsponding claw 28 which protrudes from the peripheral wall 27 of the sub tank 20. The gap between the outer peripheral section 76 and the inner peripheral section 78 is slightly wider than the thickness of the peripheral wall 27 of the sub tank 20.

A central axis 210 of the pump module 30 is positioned in a triangular area 212 which is formed by connecting the three points where the arm section 74 of the supporting member 70 snap-fits to the peripheral wall 27 of the sub tank 20. The outer periphery of a core member 82 in the suction filter 80 is covered with a thick nonwoven fabric (filtering material) 84. An inlet pipe 83 and a passage hole 82*a* are formed in the core member 82. Fuel passes the nonwoven fabric 84, and flows into the inlet pipe 83 through the passage hole 82*a*, then the fuel is drawn by the fuel pump 40. The inlet pipe 83 is linearly formed along the central axis 210 of the pump module 30. The central axis of the inlet pipe 83 and the central axis 210 of the pump module 30 are substantially coaxial. The diameter of the inlet pipe 83 is larger than its axial length. One side of a central member 86 is formed flat, and the other side of the central member 86 is formed in a convexity. The flat-shaped side of the central member 86 is connected with the core member 82 by welding or the like. An elastic member 68 is made of rubber, and its one side is formed in a concavity. The protrusion 22 is formed on the inner bottom wall of the sub tank 20 so as to surround the elastic member 88, so that the elastic member 88 is positioned. The convexity of the central member 86 contacts the concavity of the elastic member 88. The central axis of the elastic member 88 and the central axis 210 of the pump module 30 are substantially coaxial. The central axis 210 of the pump module 30 is located in the triangular area 212, which is formed by connecting the three snap-fitting points between the supporting member 70 and the sub tank 20, in the second embodiment. Therefore, the pump module 30 is not apt to vibrate with respect to the sub tank 20.

In the second embodiment, the central axis 210 of the pump module 30 is positioned in the triangular area 212, which is formed by connecting the three points where the three supporting members 70 snap-fit to the sub tank 20. Therefore, the pump module 30 is not apt to vibrate with respect to the sub tank 20. The convexity of the central member 86 slides along the concavity of the elastic member 88 when the pump module 30 vibrates. Therefore, the protrusion 22 is not apt to receive the vibration force of the pump module 30 via the elastic member 88. Accordingly, the protrusion 22 need not be formed thick so as to reinforce itself to prevent the elastic member 88 from displacing. Furthermore, in the case that the central axis 210 of the pump module 30 and the central axis of the elastic member 88 are misaligned, the pump module 30 and the elastic member 88 are automatically centered. Because, the convexity of the central member 86 slides along the concavity of the elastic member 88 so as to move toward the bottom of the concavity of the elastic member 88, guided by the concavity. Besides, the central axis of the elastic member 88 and the central axis 210 of the pump module 30 are substantially coaxial, so as to enhance the centering effect. The relationship between the central member 86 and the elastic member 88 can be opposite.

Additionally, the suction filter 80 receives weight of the pump module 30 on the central axis of the inlet pipe 83 so as to steadily support the pump module 30. Because the central axis of the inlet pope 63 is linearly formed, and besides, the central axis of the inlet pope 83 and the central axis 210 of the pump module 30 are substantially coaxial, furthermore, the diameter of the inlet pipe 83 is larger than its axial length. Thus, the vibration of the pump module 30 can be reduced. The central axis of the inlet pipe 83 and the central axis 210 of the pump module 30 are not necessarily coaxial, if the inlet pipe 83 is linearly formed along with the central axis 210 of the pump module 30. Additionally, the diameter of the inlet pipe 83 can be equal to or smaller than its axial length (Third Embodiment)

Figure 5A:
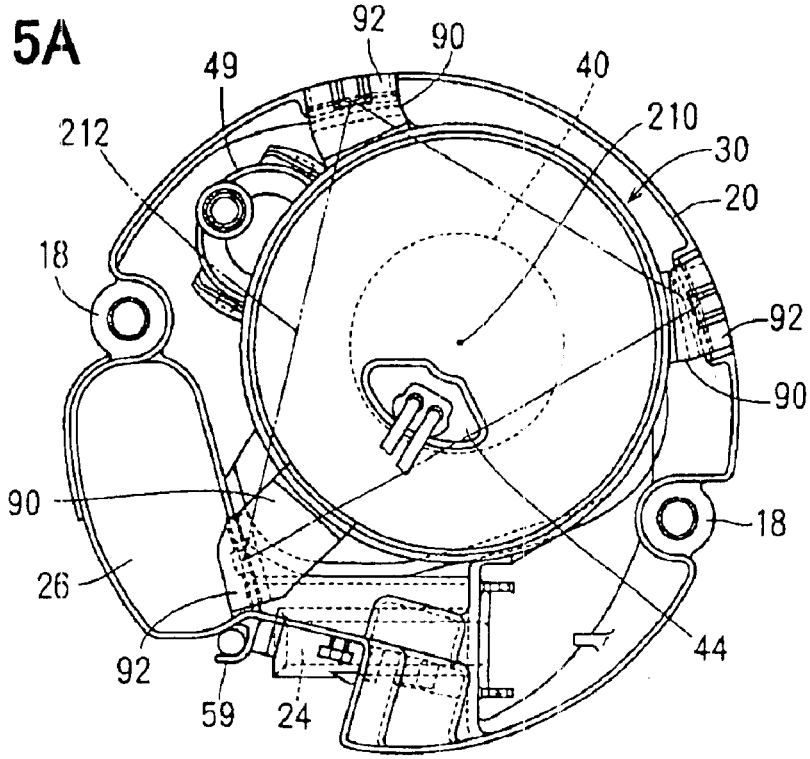
FIG. 5A is a top view showing the fuel feed apparatus according to a third embodiment of the present invention.
Figure 5B:
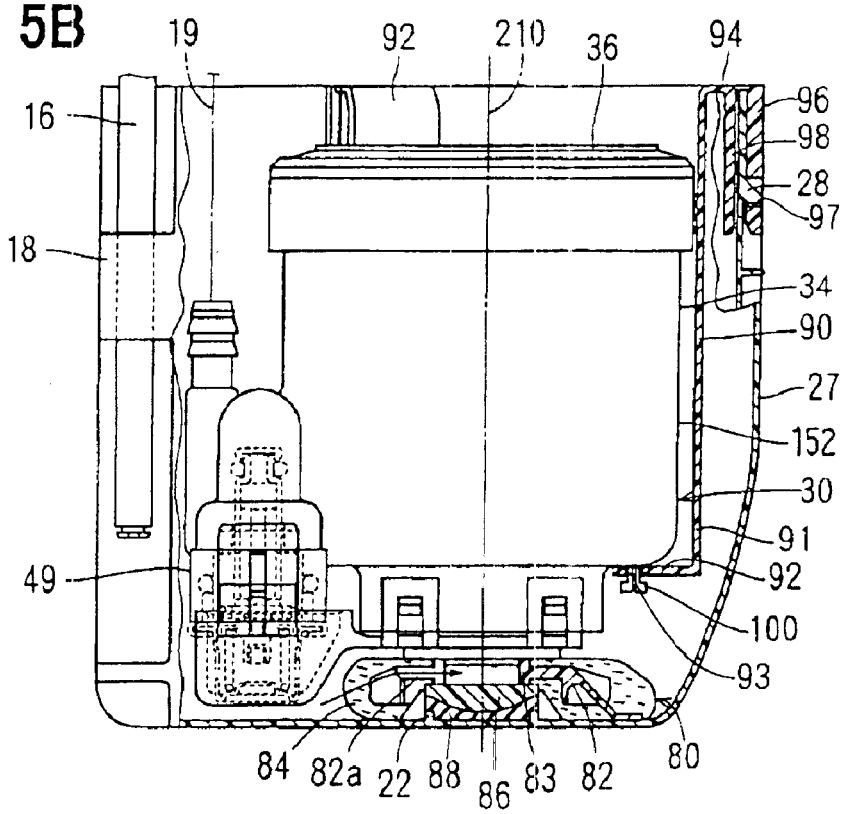
FIG. 5B is a partially cross-sectional side view showing the fuel feed apparatus according to the third embodiment.

As shown in FIG. 5, Three supporting members 90 are formed individually. The three supporting members 90 are arranged in a constant interval in the peripheral direction of the pump module 30, and connect the bottom section of the casing 34 and the sub tank 20. The central axis 210 of the pump module 30 is positioned in the triangular area 212, which is formed by connecting the three points where the three supporting members 90 snap-fit to the pump module 30 and the sub tank 20. The supporting members 90 are made of a resilient thin plate. Each supporting member 90 has a connecting section 91, a first arm section 92 and a second arm section 94. The first arm section 92 snap-fits to each corresponding protrusion 100 formed on the bottom section of the casing 34. The second arm section 94 is connected with the first arm section 92 via the connecting section 91 so as to snap-fit to the peripheral wall 27 of the sub tank 20. The protrusion 100 snap-fits to a fitting hole 93 of the arm section 92, so that the arm section 92 is connected with the bottom section of the casing 34. Each arm section 94 of the supporting member 90 has an outer peripheral section 96 and an inner peripheral section 98 for clipping The peripheral wall 27 in the diametrical direction of the sub tank 20. A window 97 is formed in each outer peripheral section 96, so as to hook each corresponding claw 28 which protrudes from the peripheral wall 27. The gap between the outer peripheral section 96 and the inner peripheral section 98 is slightly wider than the thickness of the peripheral wall 27 of the sub tank 20.

(Fourth Embodiment)

Figure 6A:
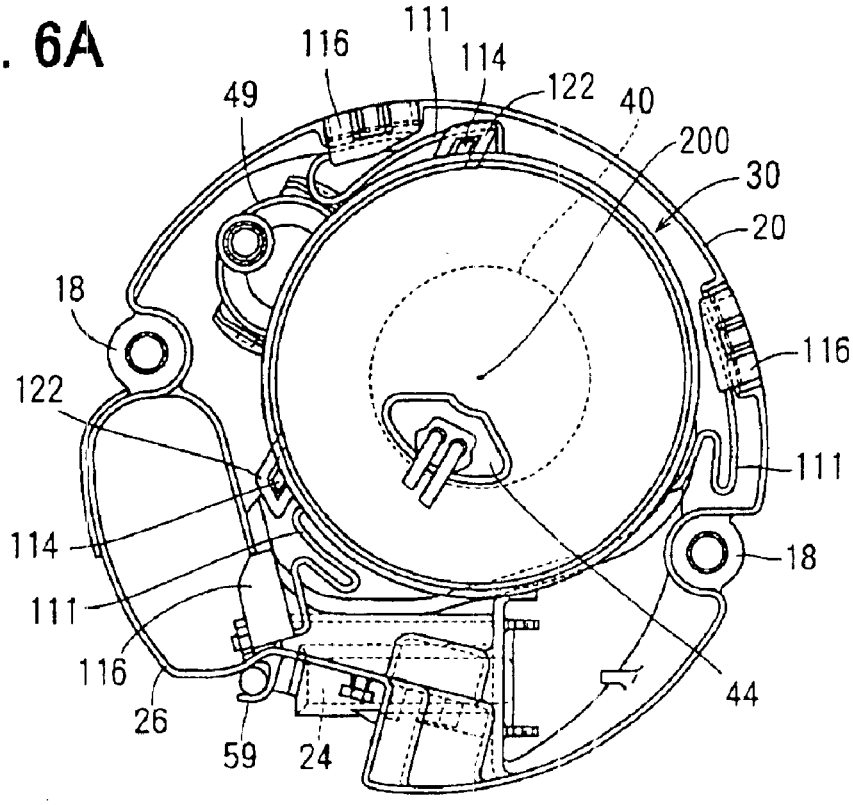
FIG. 6A is a top view showing the fuel feed apparatus according to a fourth embodiment of the present invention.
Figure 6B:
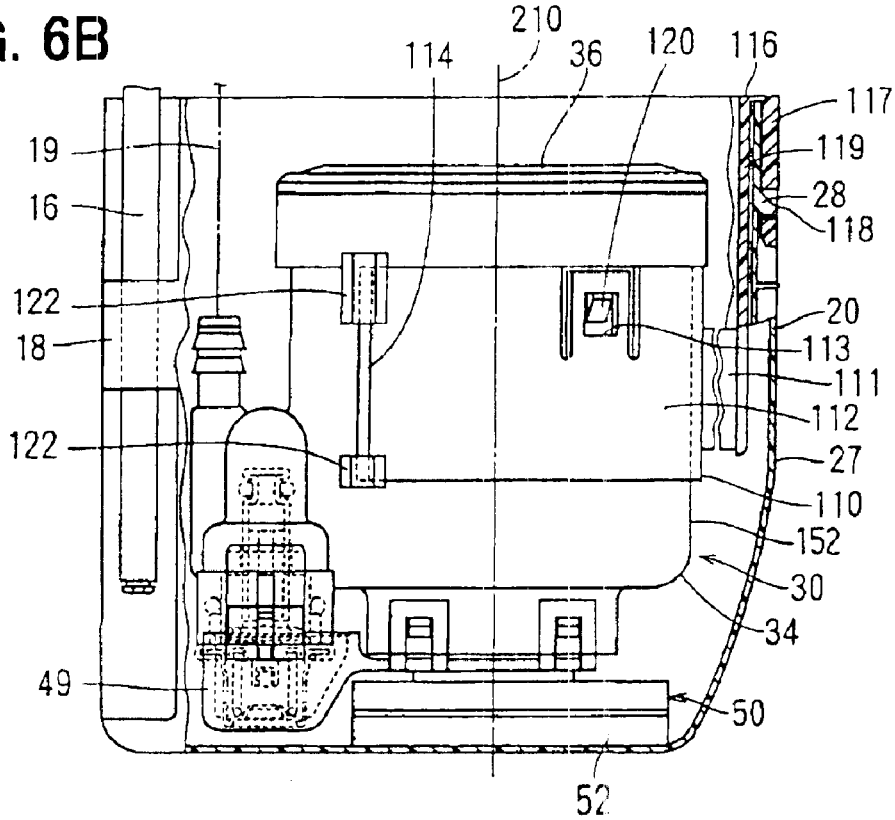
FIG. 6B is a partially cross-sectional side view showing the fuel feed apparatus according to the fourth embodiment.

As shown in FIG. 6, a supporting member 110 includes resilient members 111, a cylindrical section 112 and arm sections 116. The resilient members 111 are arranged in a substantially constant angular interval in the outer peripheral direction of the pump module 30. The cylindrical section 112 is formed in "C" shaped, and snap-fits to the casing 34 while surrounding the outer periphery of the casing 34.

The arm sections 116 are connected with the cylindrical section 112 via the resilient members 111, and snap-fit to the sub tank 20. The resilient members 111 have resilience, and are formed in a wave-shape or "S" shape so as to be used as connecting members. The central axis 210 of the pump module 30 is positioned in a triangular area which is formed by connecting three points where the three arms 116 snap-fit to the sub tank 20.

Claws 120 are formed on the outer peripheral surface of the casing 34. Windows 113 are formed at two places in the cylindrical section 112 so as to snap-fit to claws 120, so that the cylindrical section 112 is prevented from displacement in the vertical direction of the casing 34. Protrusions 114 are formed at both peripheral ends of the cylindrical section 112 so as to extend in the width direction of the cylindrical section 112. Two hooks 122 are formed at two places on the outer periphery of the casing 34 to be apart from each other in the peripheral direction of the casing 34.

Rectangular fitting hole is formed in each hook 122 so as to receive the protrusion 114. The protrusions 114 are inserted into the hooks 122 from the downward of the casing 34, so as to fit to the hooks 122, so that the windows 113 of the cylindrical section 112 snap-fits to the claws 120 of the casing 34. Thus, the cylindrical section 112 does not displace in its peripheral direction, because the protrusions 114 fit to the hooks 122.

Each arm section 116 of the supporting member 110 has an outer peripheral section 117 and an inner peripheral section 119 for clipping the peripheral wall 27 in the diametrical direction of the sub tank 20. Windows 118 are formed in the outer peripheral section 117, so as to hook the claws 28 which protrude from the peripheral wall 27 of the sub tank 20. Each gap between the outer peripheral section 117 and the inner peripheral section 119 is slightly wider than the thickness of the peripheral wall 27 of the sub tank 20.

(Fifth Embodiment)

Figure 7:
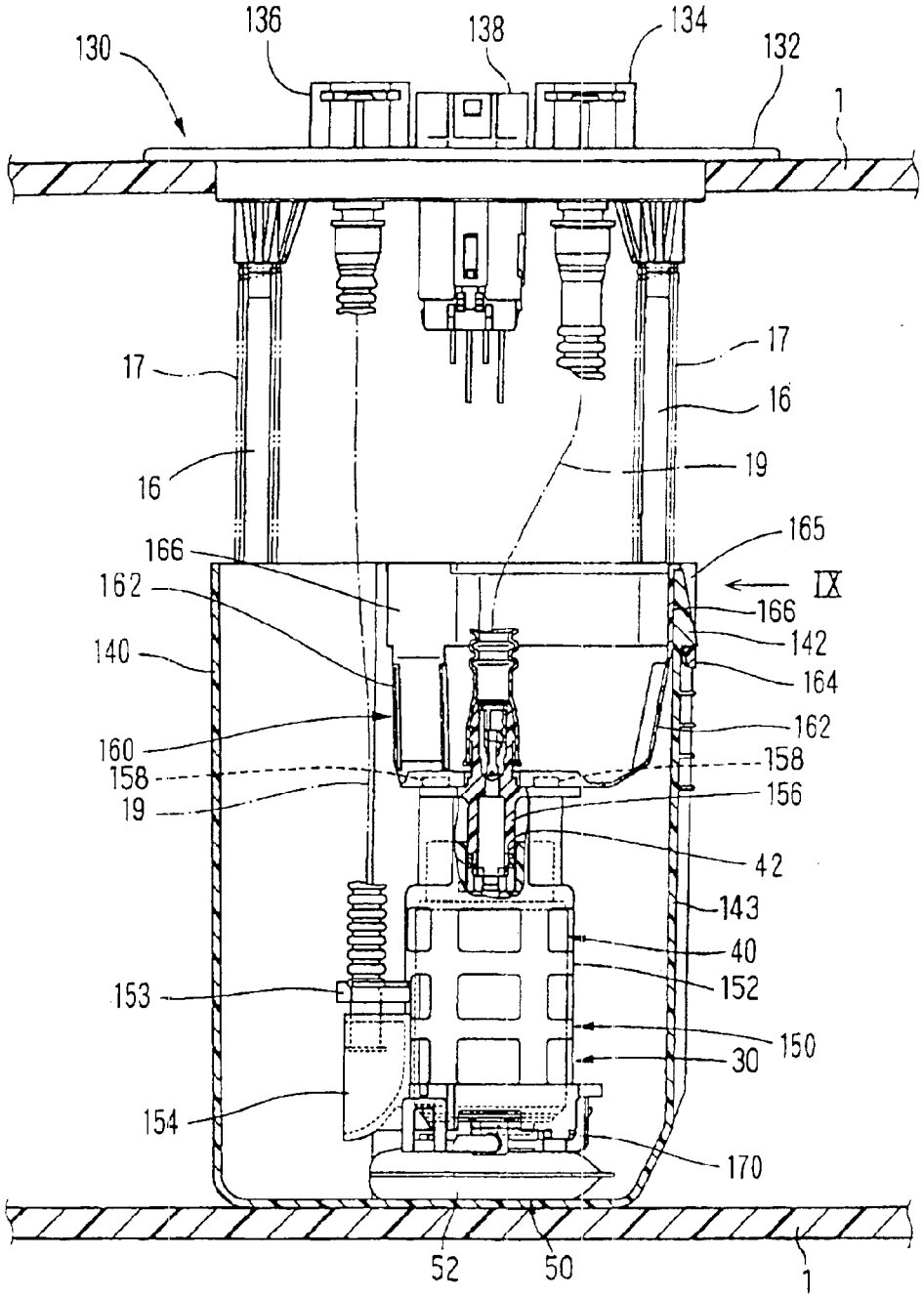
FIG. 7 is a partially cross-sectional side view showing the sub tank and the fuel pump according to a fifth embodiment of the present invention.
Figure 9:
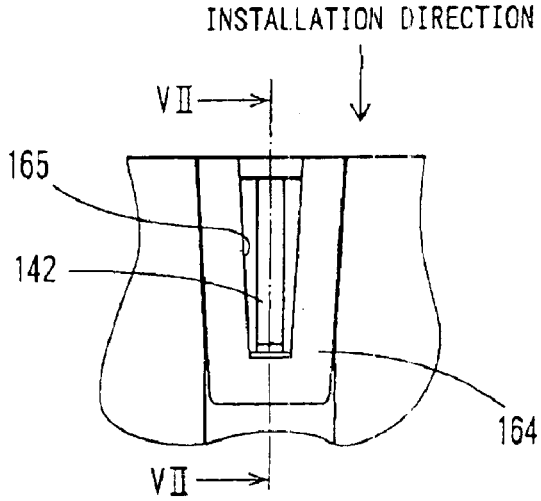
FIG. 9 is a side view from the arrow IX in FIG. 7 showing a connecting section.

As shown in FIG. 7, hooking sections 164 of a supporting member 160 hook on claws 142 of a sub tank 140. The detail of the hooking structure is shown in FIG. 9 as a cross-sectional view in VII—VII line. A fuel filter is provided in a fuel passage for removing debris in fuel discharged by the fuel pump 40, in this fifth embodiment. The fuel passage is for supplying fuel from the fuel tank 1 to an engine. The fuel passage is provided outside of the fuel tank instead of the periphery of the fuel pump 40.

As shown in FIG. 7, a disc-shaped lid 132 of a fuel feed apparatus 130 is hooked on the upper wall of the resinous fuel tank 1. A fuel discharge section 134 and a fuel return section 136 and an electric connector 138 are built on the lid 132. Fuel is discharged from the fuel pump 40 toward the outside of the fuel tank 1 via the fuel discharge section 134. Surplus fuel returns from the engine to the sub tank 140 via the fuel return section 136 and a flexible tube 19. Electric power is supplied to the fuel pump 40 via the connector 138 and lead wires.

The sub tank 140 is connected with the lid 132 via the metallic pipe 16, and pressed by the spring 17 toward the inner wall in the bottom area of the fuel tank. The fuel pump 40, the suction filter 50 and a bottomed cylindrical resinous casing 150 or the like are accommodated in the sub tank 140. A pump module is constructed of the fuel pump 40, the suction filter 50 and the casing 150.

Figure 8:
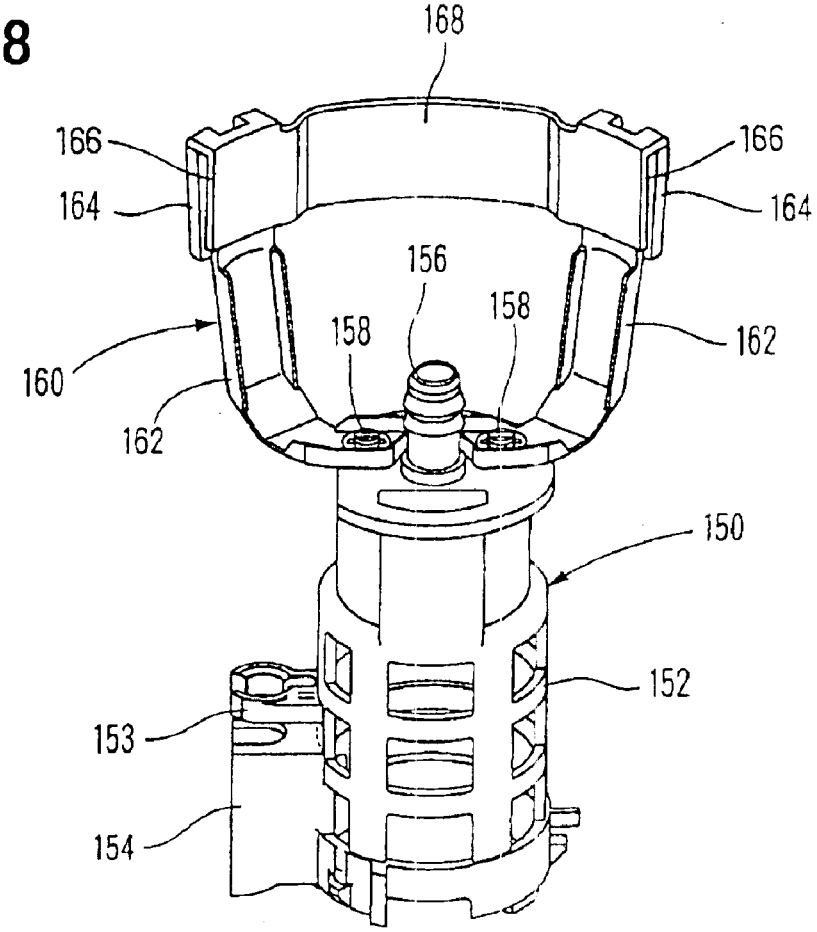
FIG. 8 is a perspective view showing a casing and the supporting member.

Inner section of the casing 150 fits to the discharge port 42 of the fuel pump 40 so as to be connected each other. A bracket 170 snap-fits to the casing 150 on the lower side of the fuel pump 40 so as to support the fuel pump 40. As shown FIG. 8, a peripheral wall 152 of the casing 150 is formed in a mesh-shape or a lattice-shape so as to have openings. Besides, amount of resin needed for manufacturing the casing 150 is decreased, and the casing 150 can be light-weight. Hooking sections 153, 154 are formed at the side of the casing 150 for holding the flexible tube 19 as shown in FIG. 7. A discharge section 156 and two protrusions 158 are formed on the casing 150. The discharge section 156 fits to the discharge port 42 of the fuel pump 40 accommodated in the casing 150. The discharge section 156 is connected with a flexible tube 19 on the outside of the casing 150 so as to be communicated with the furl discharge section 134 on the lid 132. The protrusions 158 snap-fit to arm sections 162 of the supporting member 160.

The supporting member 160 is resinous, and has two arms 162 and a connecting member 168 for connecting the arms 162. Each end of the arm 162 snap-fits to the corresponding protrusion 158 formed on the casing 150 which is positioned on the upper side of the suction filter 50. The other end of the arm section 162 has a hooking section (outer peripheral section) 164 for snap-fitting to the corresponding claw 142 of the sub tank 140. The hooking section 164 is extended in the direction where the fuel pump 40 is mounted on the sub tank 140 as shown in FIGS. 7 and 9. Windows 165 are formed in the holing sections 164, and shaped in elongated holes so as to be extended in the direction where the fuel pump 40 is mounted on the sub tank 140. The windows 165 fit to and hook on the claws. 142 of the sub tank 140, so that the hooking sections 164 snap-fit to the sub tank 140. Accordingly, two different works can be performed simultaneously, the two different works include a mounting work of the fuel pump 40 to the sub tank 140, and a manufacturing work in which the supporting member 160 is hooked on the sub tank 140. The vibration of the fuel pump 40 is absorbed by the resilient arms 162, so that the vibration is not apt to be transmitted to the sub tank 140. Besides, the nonwoven fabric 52 of the suction filter 50 contacts the inner wall in the bottom section of the sub tank 140. Therefore, the vibration of the fuel pump 40 is less transmitted to the sub tank 140 via the suction filter 50.

In the above embodiments of the present invention, the resilient supporting member joins the sub tank and the pump module. Additionally, the suction filter is connected with the inlet of the pump module, and contacts the inner wall in the bottom area of the sub tank. Vibration of the fuel pump 40 is absorbed by the resilient supporting member so as to reduce noise which is generated by transmitting vibration of the fuel pump 40 toward the outside of the fuel tank 1 through the fuel tank 1. Furthermore, the outer periphery of the suction filter is covered with the nonwoven fabric, so that vibration of the fuel pump 40 is absorbed by the suction filter as well.

The suction filter receives weight of the pump module 30, so that the supporting member need not be made strongly. Therefore, the resilient supporting member can be manufactured easily.

(Sixth Embodiment)

Figure 10:
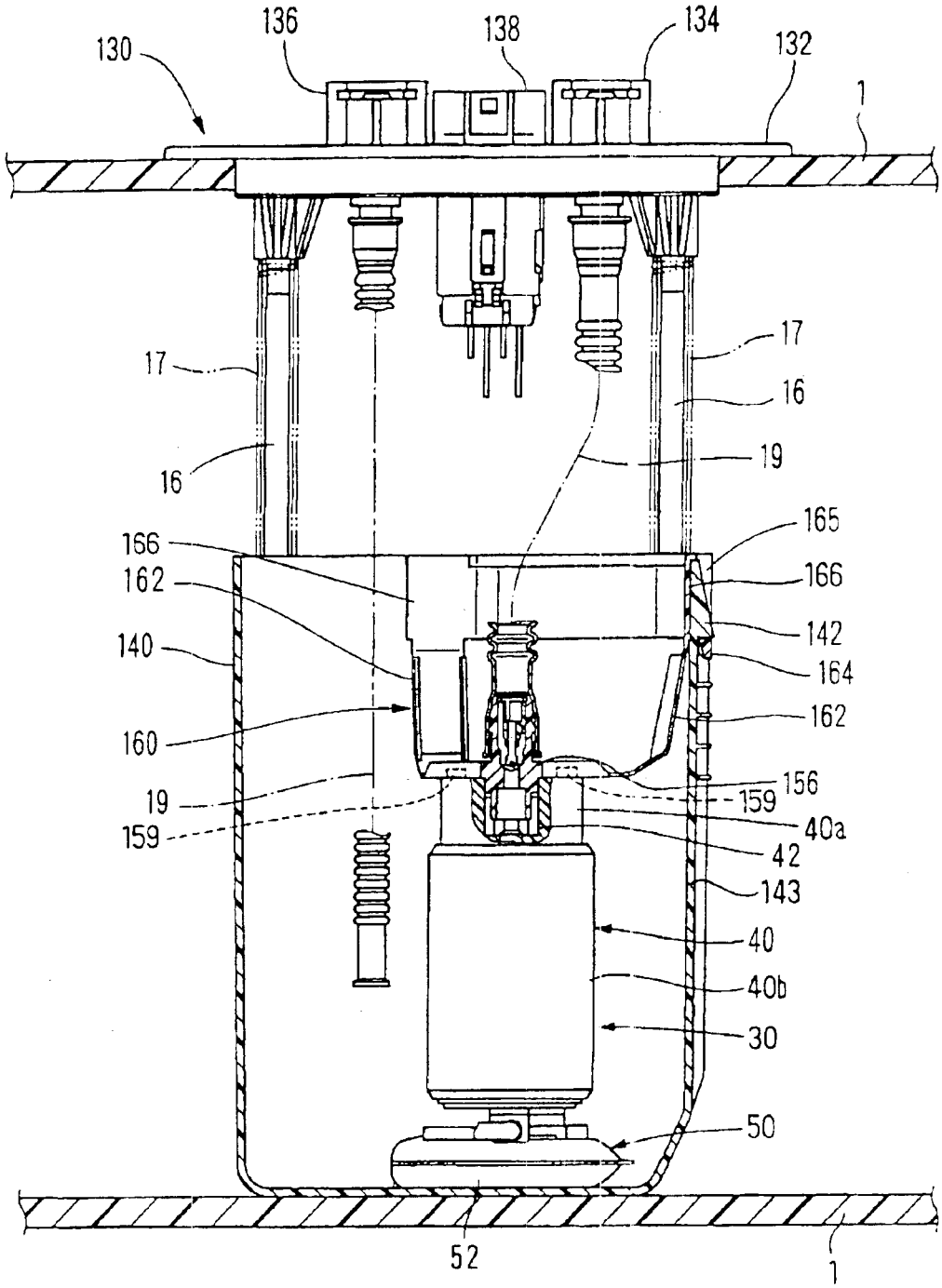
FIG. 10 is a partially cross-sectional side view showing the sub tank and the fuel pump according to a sixth embodiment of the present invention.

As shown in FIG. 10, the fuel pump 40 is disposed in the sub tank 140 without outer casing. The fuel pump 40 is mounted on the suction filter Su, and the suction side of the fuel pump 40 is connected with the suction filter 50. The suction filter 50 contacts the inner wall in the bottom area of the sub tank 140.

Figure 11:
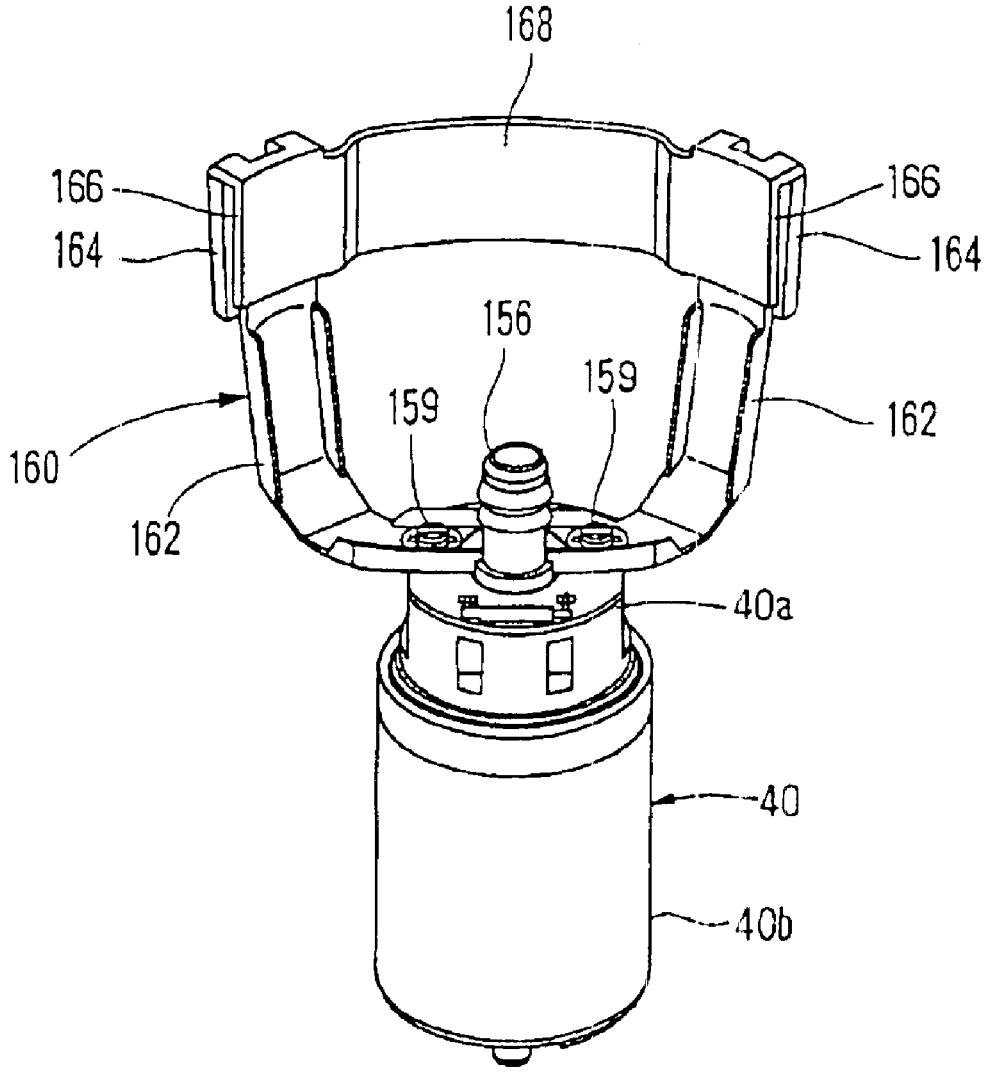
FIG. 11 is a perspective view showing the fuel pump and the supporting member.

As shown in FIG. 11, the fuel pump 40 has a resinous cover end 40*a* and a metallic body 40*b*. The resinous cover end 40*a* includes the discharge port 42 (FIG. 10). The metallic body 40*b* accommodates inner mechanisms such as the impeller and the motor and the like (not shown) as described above. The cover end 40*a* of the fuel pump 40 has protrusions 159 on its top surface. The supporting member 160 is directly snap-fitted on to the protrusions 159, so that the fuel pump 40 (more specifically, a top end surface of the cover end 40*a*) is directly connected with the supporting member 160. Back to FIG. 10, the fuel pump 40 is supported by the sub tank 140 via the supporting member 160.

In this embodiment, the flexible tube 19 is directly connected with the discharge port 42 in the cover end 40*a* at one end of the flexible tube 19. The flexible tube 19 is connected with the fuel discharge section 134 at the other end. Fuel discharged from the discharge port 42 of the fuel pump 40 is introduced toward the outside of the fuel tank 1 through the fuel discharge section 134. Another flexible tube 19 is connected with the fuel return section 136 at one end. The flexible tube 19 is freely positioned in the vicinity of the suction filter 50 at the other end.

Surplus fuel returns from the engine to the sub tank 140 through the fuel return section 136 and the flexible tube 19. The returned surplus fuel flows out of the end of the flexible tube 19 in the vicinity of the suction filter 50, so that the fuel is accumulated in the sub tank 140. The accumulated fuel is drawn toward the fuel pump 40 through the suction filter 50.

Here, a hooking member can be provided in the sub tank 140 for binding the end of the flexible tube 19 in the vicinity of the suction side of the fuel pump 40.

(Other Embodiment)

The casing 150 can be constructed of multiple parts. The supporting member can directly connect with the fuel pump, so that the resilient supporting member can connect the fuel pump and the sub tank, or the resilient supporting member can connect the fuel pump and the fuel tank, for example. In this case, the casing is used as a connecting section for directly connecting the supporting member and the fuel pump. The claws can be formed on the hooking section of the supporting member, and the windows can be formed in the sub tank so as to fit each other.

The fuel pump 40 can be directly accommodated in the fuel tank 1 instead of being accommodated in the sub tank. In this case, the resilient supporting member connects the filter case of the fuel filter and the fuel tank as a casing, or connects the casing and the fuel tank. The suction filter contacts the inner wall in the bottom area of the fuel tank. The sub tank can be integrally formed in the fuel tank so as to be a part of the fuel tank. In this case, the resilient supporting member is used as a casing for connecting the filter case of the fuel filter and the fuel tank, or connects the casing and the fuel tank. The suction filter contacts the inner wall in the bottom area of the fuel tank.

The filter element may not be the nonwoven fabric. The outer periphery of the suction filter can be covered with other material, such as a knitted casing, instead of the filter element. The knitted casing contacts the inner wall in the bottom area of the sub tank or the fuel tank. The casing of the suction filter preferably has elasticity.

The fuel pump 40 was vertically disposed in the sub tank 20 in the above embodiments, however the fuel pump can be horizontally disposed in the sub tank.

Other various changes and modifications are to be understood as being within the scope of the present invention as defined by the appended claims.

What is claimed is:

1. A fuel feed apparatus disposed in a fuel tank, the fuel feed apparatus comprising:

a sub-tank that is received in the fuel tank;

a pump module that is received in the sub-tank and includes:

a fuel pump that pumps fuel, which is supplied from the fuel tank to the sub-tank; and a suction filter that is placed below the fuel pump in a vertical direction and is connected to the fuel pump and to a bottom inner wall of the sub-tank on an opposite side with respect to the fuel pump, wherein the suction filter removes debris from fuel to be supplied to the fuel pump; and at least one supporting member that has resiliency and supports the fuel pump in cooperation with the sub-tank at a location, which is above the suction filter in the vertical directions, wherein each supporting member includes a plurality of arm sections, which are connected to the sub-tank, and are spaced from one another in a circumferential direction.

2. The fuel feed apparatus according to claim 1, wherein the pump module further includes a casing, which accommodates the fuel pump.

3. The fuel feed apparatus according to claim 2, wherein the pump module further includes a filter element, which surrounds the fuel pump and removes debris from fuel discharged from the fuel pump.

4. The fuel feed apparatus according to claim 1, wherein the at least one supporting member connects with the pump module at a location, which is above a center of gravity of the pump module.

5. The fuel feed apparatus according to claim 1, wherein the at least one supporting member connects with a top end surface of the pump module.

6. The fuel feed apparatus according to claim 1, wherein the suction filter includes a nonwoven fabric material disposed along an outer peripheral surface of the suction filter.

7. The fuel feed apparatus according to claim 1, wherein the suction filter includes a filtering material, which removes debris from fuel and has a bottom section that contacts the bottom inner wall of the sub-tank.

8. The fuel feed apparatus according to claim 1, further comprising an elastic member, which contacts the bottom inner wall of the sub-tank, wherein a bottom section of the suction filter contacts the elastic member.

9. The fuel feed apparatus according to claim 8, wherein:

a contact surface of the suction filter, which contacts the elastic member, has one of a concave surface section and a convex surface section;

a contact surface section of the elastic member, which contacts the suction filter, has the other one of the concave surface section and the convex surface section; and the concave surface section has a decreasing inner diameter that linearly decreases toward a bottom of the concave surface section.

10. The fuel feed apparatus according to claim 9, wherein the elastic member and the pump module are substantially coaxially arranged.

11. The fuel feed apparatus according to claim 1, wherein the at least one supporting member connects with the sub-tank at a plurality of connecting positions, which are spaced from one another in a circumferential direction.

12. The fuel feed apparatus according to claim 11, wherein: the plurality of connecting positions of the at least one supporting member includes at least three connecting positions; and a central axis of the pump module is located within an imaginary polygon, which has a plurality of vertexes, each of which is located in a corresponding one of the at least three connecting positions of the at least one supporting member.

13. The fuel feed apparatus according to claim 1, wherein the at least one supporting member is snap fit to at least one of the pump module and the sub-tank.

14. The fuel feed apparatus according to claim 1, wherein:

the at least one supporting member is snap fit to the sub-tank;

each arm section is snap fit to the sub-tank and includes an outer peripheral section and an inner peripheral section; and a peripheral wall of the sub-tank is held between the outer peripheral section and the inner peripheral section of each arm section.

15. The fuel feed apparatus according to claim 1, wherein:

each of the at least one supporting member further includes a plurality of connecting portions; and each connecting portion has a wave shape and is located between a corresponding one of the plurality of arm sections and the fuel pump.

16. The fuel feed apparatus according to claim 1, wherein each arm section includes a sub-tank side connecting portion, which is engaged with the sub-tank and generally extends in an installation direction of the pump module to the sub-tank.

17. The fuel feed apparatus according to claim 1, wherein an axial direction of the fuel pump coincides with an axial direction of the sub-tank.

18. The fuel feed apparatus according to claim 1, wherein: the suction filter includes a filtering material and an inlet pipe; and the inlet pipe extends linearly in an axial direction of the pump module.

19. The fuel feed apparatus according to claim 18, wherein an inner diameter of the inlet pipe is greater than an axial length of the inlet pipe.

20. The fuel feed apparatus according to claim 18, wherein the inlet pipe and the pump module are substantially coaxially arranged.

21. The fuel feed apparatus according to claim 2, wherein the casing has a peripheral wall formed in a mesh-shape or a lattice-shape.

22. A fuel feed apparatus disposed in a fuel tank, the fuel feed apparatus comprising:

a sub-tank that is received in the fuel tank;

a pump module that is received in the sub-tank and includes:

a fuel pump that pumps fuel, which is supplied from the fuel tank to the sub-tank; and a suction filter that is placed below the fuel pump in a vertical direction and is connected to the fuel pump and to a bottom inner wall of the sub-tank on an opposite side with respect to the fuel pump, wherein the suction filter removes debris from fuel to be supplied to the fuel pump;

at least one supporting member that has resiliency and supports the fuel pump in cooperation with the sub-tank at a location, which is above the suction filter in the vertical direction; and an elastic member, which contacts the bottom inner wall of the sub-tank, wherein:

a bottom section of the suction filter contacts the elastic member, a contact surface of the suction filter, which contacts the elastic member, has one of a concave surface section and a convex surface section, a contact surface section of the elastic member, which contacts the suction filter, has the other one of the concave surface section and the convex surface section, and the concave surface section has a decreasing inner diameter that linearly decreases toward a bottom of the concave surface section.

23. The fuel feed apparatus according to claim 22, wherein the elastic member and the pump module are substantially coaxially arranged.

24. A fuel feed apparatus disposed in a fuel tank, the fuel feed apparatus comprising:

a sub-tank that is received in the fuel tank;

a pump module that is received in the sub-tank and includes:

a fuel pump that pumps fuel, which is supplied from the fuel tank to the sub-tank; and a suction filter that is placed below the fuel pump in a vertical direction and is connected to the fuel pump and to a bottom inner wall of the sub-tank on an opposite side with respect to the fuel pump, wherein the suction filter removes debris from fuel to be supplied to the fuel pump; and at least one supporting member that has resiliency and supports the fuel pump in cooperation with the sub-tank at a location, which is above the suction filter in the vertical direction, wherein:

the at least one supporting member connects with the sub-tank at a plurality of connecting positions, which are spaced from one another in a circumferential direction, the plurality of connecting positions of the at least one supporting member include at least three connecting positions, and a central axis of the pump module is located within an imaginary polygon, which has a plurality of vertexes, each of which is located in a corresponding one of the at least three connecting positions of the at least one supporting member.

25. A fuel feed apparatus disposed in a fuel tank, the fuel feed apparatus comprising:

a sub-tank that is received in the fuel tank;

a pump module that is received in the sub-tank and includes:

a fuel pump that pumps fuel, which is supplied from the fuel tank to the sub-tank; and a suction filter that is placed below the fuel pump in a vertical direction and is connected to the fuel pump and to a bottom inner wall of the sub-tank on an opposite side with respect to the fuel pump, wherein the suction filter removes debris from fuel to be supplied to the fuel pump; and at least one supporting member that has resiliency and supports the fuel pump in cooperation with the sub-tank at a location, which is above the suction filter in the vertical direction, wherein:

the at least one supporting member is snap fit to the sub-tank;

each of the at least one supporting member includes a sub tank side connecting portion, which is snap fit to the sub-tank and includes an outer peripheral section and an inner peripheral section; and a peripheral wall of the sub-tank is held between the outer peripheral section and the inner peripheral section of each of the at least one supporting member.

* * * * *